United States Patent [19]

Liet

[11] Patent Number: 4,672,835

[45] Date of Patent: Jun. 16, 1987

[54] APPARATUS FOR BENDING SHEET MATERIAL

[76] Inventor: Cornelis H. Liet, Denekamperdijk 38, 7581 PJ Losser, Netherlands

[21] Appl. No.: 657,724

[22] Filed: Oct. 4, 1984

[30] Foreign Application Priority Data

Oct. 10, 1983 [NL] Netherlands ..... 83 03472
Jun. 8, 1984 [EP] European Pat. Off. ..... 84200814

[51] Int. Cl.[4] ..... B21D 9/05
[52] U.S. Cl. ..... 72/389; 72/415
[58] Field of Search ..... 72/396, 415, 454, 389

[56] References Cited

U.S. PATENT DOCUMENTS 2,312,755 3/1943 Dehn ..... 72/415
3,845,655 11/1974 Krieg ..... 72/389

*Primary Examiner*—W. D. Bray
*Attorney, Agent, or Firm*—Pahl, Lorusso & Loud

[57] ABSTRACT

An apparatus for bending sheet material is provided with a die having at least one longitudinally extending groove and a stamp having at least one linear contact zone for contacting the sheet material to be bent. The die and the stamp are movable towards each other. The die comprises at least one reciprocable die part adapted to define the size and the shape of the groove.

14 Claims, 11 Drawing Figures

APPARATUS FOR BENDING SHEET MATERIAL

The apparatus relates to an apparatus for bending sheet material, including a die having at least one longitudinally extending groove and a stamp having at least one linear contact zone for contacting the sheet material to be bent, the die and the stamp being movable towards each other.

BACKGROUND OF THE INVENTION

In the known apparatus of this sort regularly a different die has to be mounted in order to accommodate the groove extending in the die as to its shape and size in accordance with the kind and the thickness of sheet material to be bent and the desired shape to be bent. Exchanging the die, however, is relatively time consuming.

An other serious draw back of the known apparatus is that during bending of the sheet material the surface thereof slides along the groove defining edges of the die whereby a strong wear of the die is effected, while the accuracy of the dimensions of the shape to be bent is reduced. Furthermore, the sliding of the surface of the sheet material to be bent along the said edges of the die requires large forces for the deformation of the sheet material, while furthermore the surface of the sheet material may be easily damaged.

SUMMARY OF THE INVENTION

The invention has the object of providing an apparatus of the kind indicated hereinabove in which the drawback requiring different dies for different kinds and thicknesses of sheet material to be bent has been overcome in a simple but nevertheless efficient manner.

For this purpose the apparatus according to the invention is characterized in that the die includes at least one reciprocable die part adapted to define the size and the shape of the groove.

In this manner it is possible to adjust the size and the shape of the groove in the die simple by moving the reciprocable die part so that accomodating the groove in accordance with the kind and thickness of the material to be bent and the desired shape to be bent can take place very quickly.

In a favourable embodiment of the invention the die includes two die parts disposed on either side of a vertical centre plane in which the contact zone of the stamp is situated, each of said die parts being reciprocable relative to said vertical centre plane, and preferably both die parts are simultaneously reciprocable with equal speed.

In a preferred embodiment of the apparatus of the invention the drawback resulting in the sheet metal sliding along the groove-defining edges of the die back is overcome in that the (each) die part starting from a position in which the stamp has its contact zone just contacting the sheet material to be bent, in dependency of the relative movement of the stamp and the die, are movable relative to the contact zone of the stamp in such a manner that the distance between the contact zone of the stamp and the linear contact zone of the (each) die part with the sheet material to be bent remains substantially constant during bending.

Thereby the surface of the sheet material to be bent during bending does not substantially slide along the or each die part so that no wear of the die parts takes place and the surface of the sheet material cannot be damaged. Furthermore, the accuracy of the dimensions will be maintained during the bending.

In a favourable embodiment of the invention the (each) die part is movable to a position in which the groove of the die is fully closed and the stamp includes at least one reciprocable stamp part adapted to define the size and the shape of a groove in the stamp.

In this manner the die may be used as a stamp and the stamp as a die, so that for bending of a Z-profile, for example, there is no necessity of turning the sheet material.

In this manner such profiles requiring bending to be done in two opposite directions may be formed without turning the sheet material, which considerably increases the accuracy of the obtained profile.

In this embodiment in accordance with the invention it is to be preferred that the (each) stamp part starting from a position in which the die brought into the closed position has a contact zone just contacting the sheet material to be bent, in dependency of the relative movement of the stamp and the die, is movable relative to the contact zone of the die in such a manner that the distance between the contact zone of the die and the contact zone of the (each) stamp part with the sheet material to be bent remains substantially constant during bending.

In the apparatus of the kind mentioned hereinabove the turning of the sheet material to be bent also may be avoided in that the die and the stamp each include a pivotably supported carrier, said carriers each carrying at least a die part and a stamp part which may be positioned into a working position by pivoting of the carrier.

In a favourable embodiment of the apparatus of the invention the stamp is mounted for pivoting about an axis lying in the vertical centre plane and has at least one longitudinal end coupled to an operating means for pivoting the stamp, said stamp being pivotable through such an angle that with the stamp parts moved from each other the contact zone of at least one stamp part may be positioned into the vertical centre plane.

Thereby the one stamp part of which the contact zone is pivoted into the vertical centre plane, may be used as a stamp so as to enable the bending of certain profiles, wherein a part of the already bent profile is received into the groove between the stamp parts.

In an embodiment of the invention wherein a base is provided having a support surface for the sheet material to be bent, the stamp and the die according to the invention are tiltable relative to the base about a longitudinal axis which substantially coincides with the contact zone between the die part disposed at the side of the support surface and the sheet material to be bent.

Thereby the part of the sheet material to be bent, which during bending is disposed on the support surface, remains supported on this support surface.

In accordance with the invention in an apparatus including an abutment for the sheet material to be bent it is to be preferred that the abutment is supported by a frame which is pivotably connected with one of said die parts about a pivoting axis which substantially coincides with the contact zone between said one die part and the sheet material to be bent.

In this case it is advantageous that two abutment jaws are provided in which the respective end edge of the sheet material to be bent may be clamped.

In this manner an apparatus is obtained which is capable of keeping the sheet material to be bent during the whole process of the formation positioned in the right manner so as to make possible particularly exact dimensions.

In accordance with the invention the frame includes a support beam which is parallel to the pivoting axis, and two arms are mounted on the support beam for sliding motion in parallel to said pivoting axis, each arm at its end carrying an abutment jaw, and the support beam is slidable transversely of said pivoting axis.

In this case preferably the frame is connected with a base of the apparatus by an actuating means which effects the pivotal motion of the frame in dependency of the relative movement of the stamp and the die. Thereby the pivoting movement of the frame in accordance with the movement of the stamp relative to the die may be controlled whereby when using a suitable control unit the complete bending process for obtaining a desired profile may be performed completely automatically.

When for bending certain profiles the sheet material to be bent should be turned in a horizontal plane, the frame in a favourable embodiment includes a rotary platform substantially disposed in the centre for retaining the sheet material to be bent thereon.

The costs of manufactoring the apparatus of the invention may be kept low, when the movable die parts and the movable stamp parts, if any, are similar to each other.

The invention will hereinafter be explained by reference to the drawing schematically illustrating some embodiments.

DETAILED DESCRIPTION OF THE PREFERRED EMBODIMENTS

Figure 1:
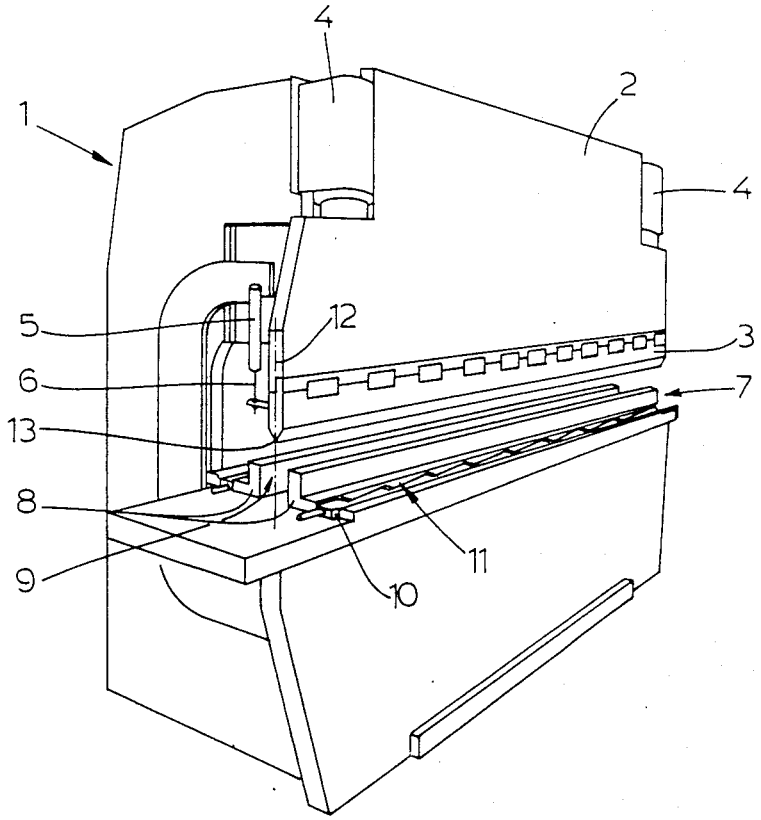
FIG. 1 is a schematically represented perspective view of a first embodiment of the apparatus of the invention.

In FIG. 1 a first embodiment of the apparatus for bending sheet material is designated with the reference number 1, and includes a stamp 3 carried by an upper beam 2, the stamp being downwardly movable by hydraulic cylinders 4 for bending the sheet material. The piston position of the cylinders 4 is determined by potentiometers 5 disposed at either side of the upper beam 2 and of which only one is shown in FIG. 1. The upper beam 2 for that purpose is connected by a wire 6 with the runners of the potentiometers 5. The electric signals delivered by the runners of the potentiometers 5 and corresponding with the position of the upper beam 2 can be used by a suitable electronic control unit for controlling the hydraulic cylinders 4.

The apparatus 1 is further provided with a die 7 including two movable die parts 8. The die parts 8 which define a groove 9 between them, at their side remote from the groove 9 each are provided with a saw teeth-like side cooperating with a complementary saw teeth-like side of a slidable operating rod 10 as designated with 11. By the sliding of the operating rod the die parts 8 can be reciprocated so that the size of the groove 9 in dependency of the kind and thickness of the sheet material to be bent and the profile to be shaped can be adjusted. Both die parts 8 are disposed at either sides of a vertical centre plane designated by a broken line 12, a linear contact zone 13 of the stamp 3 being disposed in said plane, the stamp 3 with said contact zone 13 contacting the sheet material to be bent. Both die parts are simultaneously reciprocable relative to the said vertical centre plane with equal speed.

Figure 2:
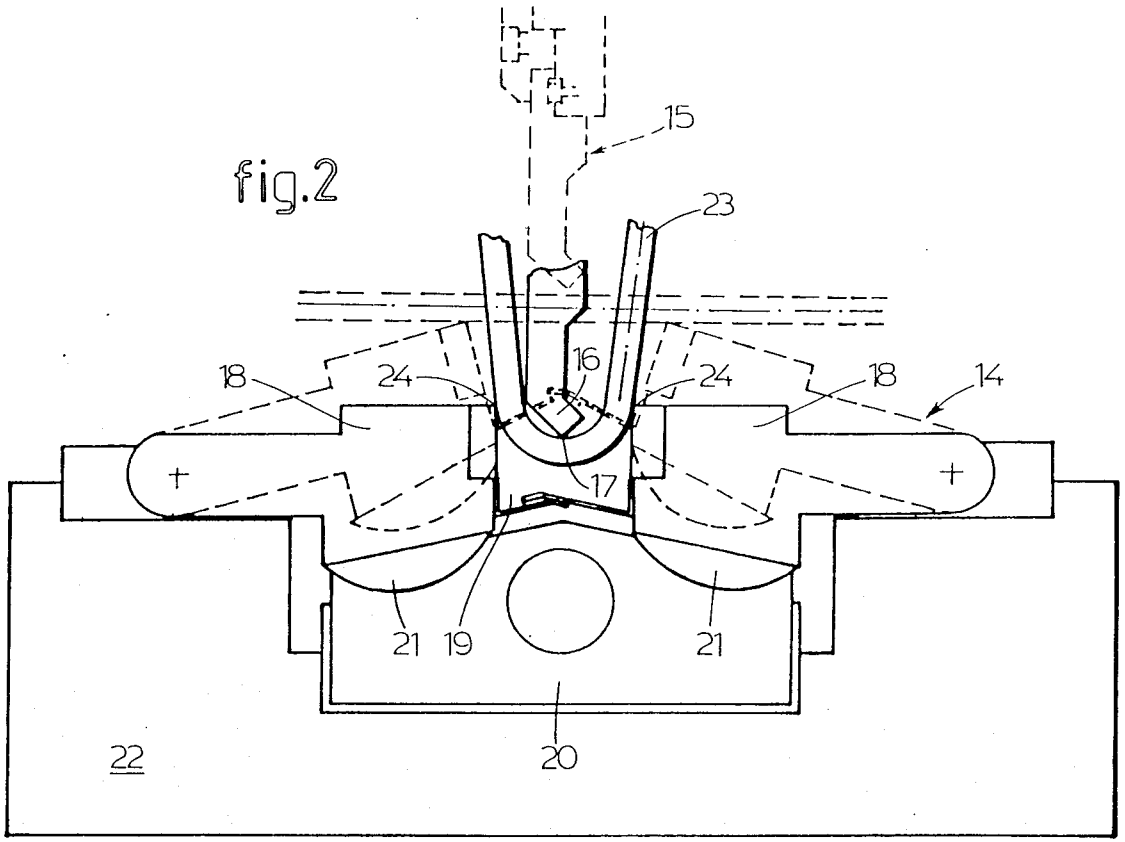
FIG. 2 is a schematically partially represented side view of a second embodiment of the apparatus of the invention, wherein the movable die parts and the stamps are represented in two positions.

FIG. 2 schematically represents a side view of a second embodiment of the apparatus for bending the sheet material and mainly shows a die 14 and a stamp 15. The die 14 consists of an elongate beam of U-shaped cross section. The stamp 15 is of equal length as the die 14 and in this case is provided with a tip 16 of V-shaped cross section forming a linear contact zone 17, with which the stamp 15 contacts the sheet material 23 to be bent.

In FIG. 2 two different working positions of the apparatus have been drawn, a broken line designating the starting position and a solid line the end position. The die 14 in this embodiment is provided with two die parts 18 which are pivotally mounted in the die 14 and which define a groove 19 in the die. By pivoting of the die parts 18 the size and the shape of the groove 19 can be defined. Furthermore it is possible to control the pivoting motion of the die parts 18 in dependency of the movement of the stamp 15 so as to realize important advantages. The pivoting motion of the die parts 18 can be obtained in various manners, for example by supporting the die parts 18 on a series of support blocks 20 with interposition of a cylindrical cavity bearing 21, while the support blocks at the lower side each are provided with a surface inclined in the direction perpendicular to the plane of the drawing and cooperating with an inclined surface formed in the fixed die part 22. By movement of the support blocks 20 perpendicular to the plane of the drawing with a suitabe operating means the die parts 18 may be pivoted upwardly and downwardly.

The control unit may control the pivoting motion of each die part 18 starting from a position designated by the broken line, in which the stamp 15 with its contact zones 17 just contacts the sheet material 23 to be bent, in such manner relative to the contact zone 17 of the stamp 15 that the distance between this contact zone 17 and the linear contact zone 24 of each die part 18 with the sheet material 23 to be bent remains substantially constant during bending. The movement of the stamp 15 may be determined with potentiometers in the same manner as hereinabove described.

Hereby it is reached that the sheet material will not substantially slide over the contact zones 24 of the die parts 18 during bending whereby wear of the die parts 18 and damage to the sheet material is avoided. Furthermore the desired profile can be shaped in this manner with high accuracy.

Under circumstances, for example when a profile to be shaped is already partially bent, it is possible to cause the die parts 18 to perform relatively different pivoting motions, in which case each die part 18, of course, requires a separate operating mechanism.

Figures 3, 5:
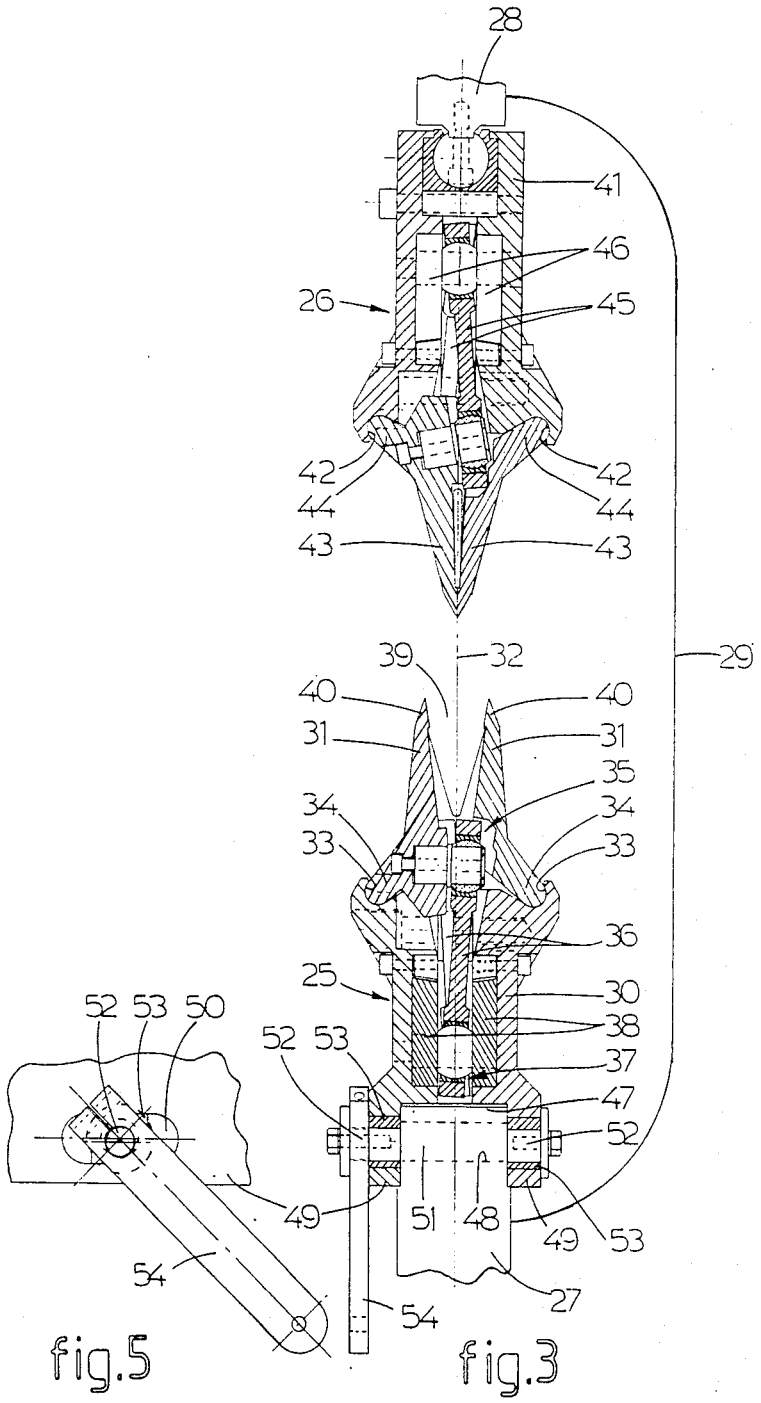
FIG. 3 is a partially represented section of a third embodiment of the apparatus of the invention, representing the stamp and the die only.
FIG. 5 is a part of the lower side of the die of FIG. 3 represented in side view.

FIG. 3 schematically represents a section of an embodiment of the apparatus of the invention for bending sheet material and mainly shows a die 25 and a stamp 26. A single line 29 designates the connection between an upper beam 28 and a lower beam 27, which connection, of course, will always be present. The die 25 is provided with a die carrying member 30 supported by the lower beam 27 and two movable die parts 31 disposed at either side of the vertical centre plane designated by a broken line 32.

For each movable die part 31 the die carrying member 30 includes a longitudinally extending bearing cavity 33 in which the respective die part 31 is pivotably supported with an extension 34 of partly circular section. Furthermore each movable die part 31 by a ball-joint 35 is connected with the ends of a plurality of arms 36 spaced throughout the length of the die 25. The arms have their other ends also connected by a ball-joint 37 with an operating rod 38 (see also FIG. 4), which in the represented embodiment is common to both die parts 31. The operating rod is longitudinally slidably mounted in the die carrying member 30 and at one end coupled to an operating means in a manner not illustrated. By the operating means sliding the operating rod 38 the die parts 31 may be pivoted back and forth so that the size and the shape of the groove 39 defined between the die parts 31 may be adjusted. Thereby the die parts 31 may be positioned with their ends 40 against each other so that the groove 39 is fully closed. Thereby the die 25 may also be used as a stamp.

In the apparatus of FIG. 3 the stamp 26 is mainly embodied in the same manner as the die 25 and is provided with a stamp carrying member 41 connected with the upper beam 28 and having two longitudinally extending bearing cavities 42 in which movable stamp parts 43 may be pivotably supported with an extension 44 of partly circular section. The pivoting motion of the stamp parts 43 is effected in a similar way by arms 45 and an operating rod 46. By the stamp parts 43 being pivoted into the open position a groove may be defined in the stamp 26 so that the stamp 26 may function as a die.

In this manner with the apparatus illustrated in FIG. 3 sheet material can be bent in two directions without the necessity of turning the sheet material, whereby the use of the apparatus is considerably facilitated and the accuracy of the profile to be shaped is increased.

The pivoting motion of the movable die parts 31 and the movable stamp parts 43, respectively, can be controlled by a suitable control unit in dependency of the movement of the stamp 26 relative to the die 25 starting from a position in which the stamp 26 respectively the die 25 with the contact zones just contacts the sheet material to be bent in such manner relative to the contact zone of the stamp 26 respectively the die 25 that the distance between the various contact zones remains substantially constant during bending.

Figure 4:
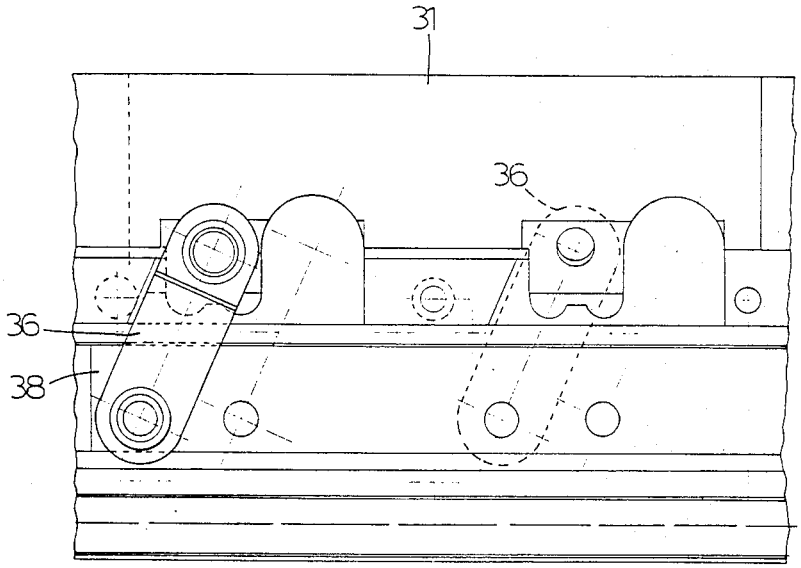
FIG. 4 is a partly represented schematical side view of the die of FIG. 3.

It is known that in an apparatus for bending sheet material, in particular with a great length of the sheet material to be bent, the work piece from the centre thereof towards the ends is bent through an ever increasing angle by deformation or deflection of the stamp and the die. This deformation or deflection can be compensated, for example by cambering the die, that is making it somewhat round intentionally. In the apparatus of FIGS. 3 and 4 the cambering is relatively simple.

The die carrying member 30 at the lower side is provided with a channel 47 of inverted U-shaped section, in which the upper end of the lower beam 27 is received. In this upper end are arranged bores 48 spaced regularly throughout the length and designated in FIG. 3 by a dotted line. In the side walls 49 of the channel 47 slots 50 are formed at each bore 48 as may be seen in the FIGS. 3 and 5. In each bore 48 a shaft 51 is fitted and this shaft 51 at both ends carries eccentric stub axles 52 projecting into the slots 50. The stub axles 52 are pivotably journaled in slide blocks 53 mounted in the slots 50. On one of the stub axles 52 in a manner not illustrated a drivable operating arm 54 is secured for rotating the respective shaft 51. When the operating arms 54 are pivoted, the shaft 51 will turn whereby the die 25 locally as a result of the excentric stub axles will somewhat move downwardly or upwardly. Thereby it is possible to camber the die 25 in a relatively simple manner.

Figure 6:
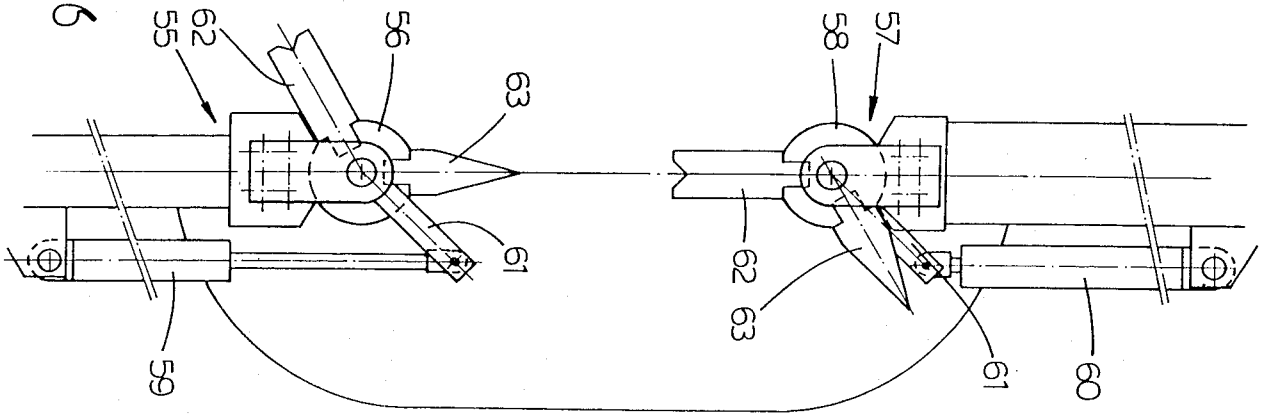
FIG. 6 is a schematically represented side view of a fourth embodiment of the apparatus of the invention.

FIG. 6 represents an alternative embodiment of the apparatus which is embodied in such manner that the sheet material to be bent also can be bent in two directions without turning of the sheet material. The apparatus of FIG. 6 for that purpose is provided with a die 55 having a rotatably supported carrier 56 and a stamp 57 having a rotatably supported carrier 58. The pivoting motion of the carrier 56, 58 is effected by an associated operating means 59, 60 which by an arm 61 is connected with the respective carrier. Each carrier 56, 58 includes a die part 62 and a stamp part 63 which may be positioned into a working position by the rotation of the respective carrier. The radial distances of the pivoting axis of the carrier 56, 58 to the contact zone of the stamp part 63 respectively the support surface of the die part 62 preferably are equal so that the height of the not illustrated support surface supporting the sheet material does not have to be adjustable. The angular distance between the die part 62 and the stamp part 63 is larger than 90° as appears from FIG. 6.

It is noted that the above-described embodiment of the die carrying member 30 and the lower beam 27 with the shafts 51 mounted therein for cambering the die also can be used in the embodiment of the apparatus of FIG. 6.

Figure 7:
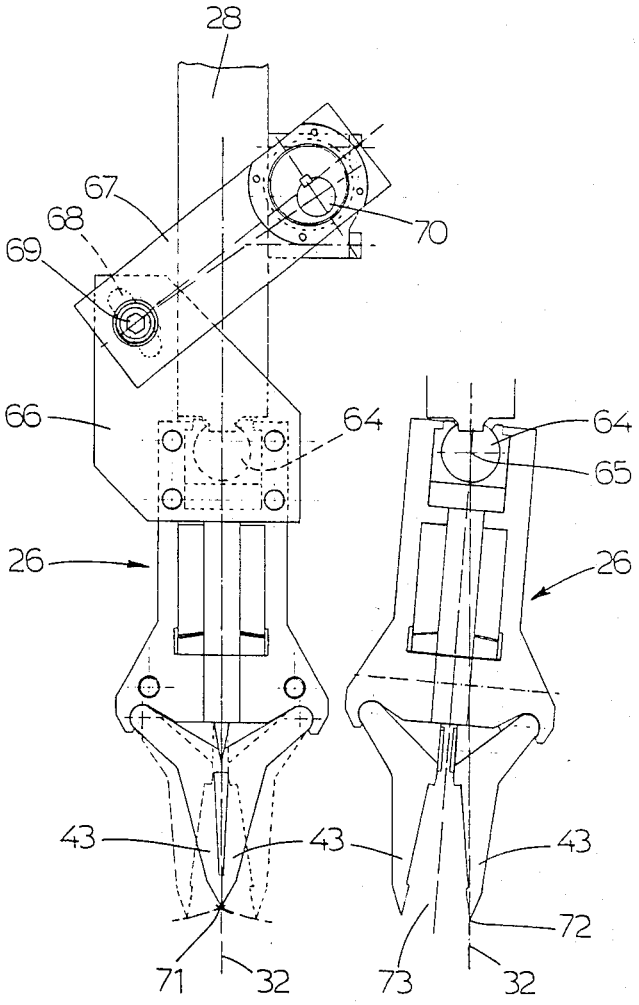
FIG. 7 is a schematically represented side view of a pivotally mounted stamp of the invention.

FIG. 7 represents a side view of the stamp 26. The stamp 26 by a cylindrical bearing 64 is connected with the upper beam 28 so that the stamp 26 is pivotal about the axis 65 of this cylindrical bearing 64, which axis is disposed in the vertical centre plane 32. At both ends the stamp 26 is provided with a coupling plate 66 through which the stamp 26 is coupled with an operating arm 67 and for that purpose a slot 68 is disposed in the coupling plate 66 and traversed by a connecting bolt 69. The other end of the operating arm 67 is coupled with an actuating rod 70 which is common to both operating arms.

Thereby the stamp 26 from the normal position shown in the left part of FIG. 7, in which the contact zone 71 of the stamp parts 43 positioned in the closed position is disposed in the vertical centre plane 32, may be pivoted to the position shown in the right parts of FIG. 7, in which the contact zone 72 of one of the stamp parts 43 positioned to the fully open position is disposed in the vertical centre plane. The stamp may also be pivoted to the right in the drawing so that the contact zone of the other stamp part 43 will be positioned in the vertical centre plane. In this position of the stamp 26 only one stamp part 43 is used as a stamp whereby it is possible to bend profiles in such manner that part of the sheet material to be bent may be received into the groove 73 between both stamp parts 43.

Figure 8:
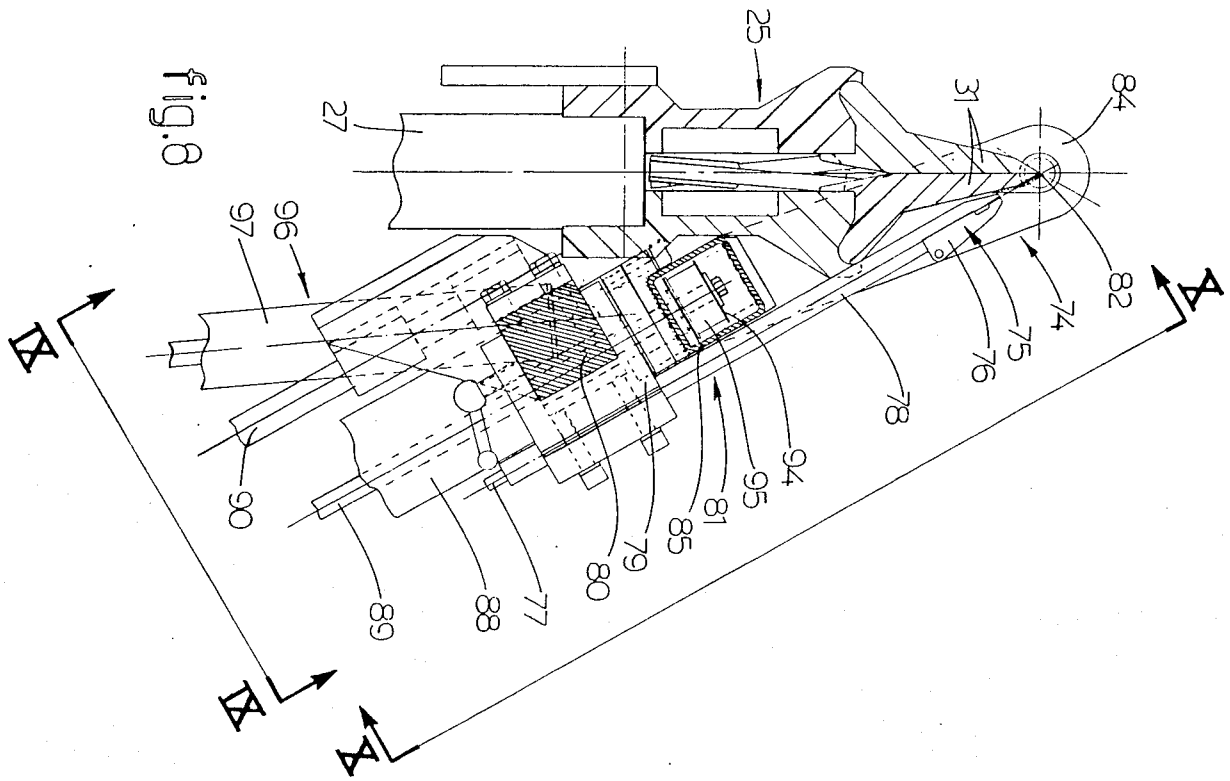
FIG. 8 is a side view, partly in section, of an embodiment of the die of the apparatus of the invention including a pivotal abutment.

FIG. 8 represents a section, partly in side view, of the die 25, in which an adjustable abutment is provided which as a whole is designated as 74. As also appears from FIGS. 9 and 10 the abutment 74 includes two abutment jaws 75 in which an end edge of the sheet material to be bent can be clamped. For this purpose the one jaw part 76 of both abutment jaws 75 in a manner not illustrated may be operated by a rod 77. The abutment jaws 75 are disposed each on the one end of an arm 78, which arms 78 are mounted on slide blocks 79 which are slidably ranged on a support beam 80. The support beam 80 is part of a frame 81 which is pivotably connected with this die part 31 about a pivoting axis substantially coinciding with the contact zone 82 between the one die part 31 and the sheet material to be bent. The support beam 80 extends in parallel to the pivoting axis designated with 83 in FIG. 10 so that the arms 78 are slidable in parallel to this pivoting axis across the support beam 80 for accommodating the width of the sheet material to be bent.

The frame 81 is provided with two arms 84, of which the first ends are pivotably connected with the said die part 31. On the other ends of the arms 84 a box beam 85 is secured, which extends beyond the one arm 84 and supports a drive motor 87 on this extending end 86. On the box beam 85 two boxes 88 are mounted and in each of them a screw spindle 89 is rotatably journaled. Each box 88 carries a guide rod 90 in parallel to the screw spindle 89. The support beam 80 at both its ends is provided with an extension 91 in which a threaded bore 92 is formed cooperating with the respective screw spindle 89, and with a guide element 93 cooperating with the respective guide rod 90.

The screw spindles 89 with their one end project into the box beam 85 and at this end are provided with toothed-belt pulleys 94, through which the screw spindles 89 are coupled to the drive motor 87 by toothed belts 95. In this manner the support beam 80 by the actuation of the motor 87 can be moved transversely of the pivoting axis 83 so that the distance between the abutment jaws 75 and the die 25 is adjustable in accordance with the desired location of the shape to be bent into the sheet material.

The frame 81 by an actuating mechanism 97 is connected with the lower end of the lower beam 27 or a base (not illustrated) of the apparatus, which carries this lower beam 27. In the embodiment represented in FIGS. 8–10 this actuating mechanism 97 consists of two not visible screw spindles which are rotatably journaled in boxes 97 which are coupled to the boxes 88. The screw spindles are drivable by a motor 98 through not visible toothed belts running in a protective box 99. In this manner the pivoting motion of the frame 81 may be effected.

The pivoting motion in this case is dependent of the relative movement of the stamp 26 and the die 25. The movement of the stamp 26, for example, can be determined in the manner described in connection with FIG. 1 with a potentiometer which is coupled to a control unit. The control unit controls the motor 98 in such manner that the pivoting movement of the frame 81 exactly follows the movement of the sheet material during bending. When the desired shape has been bent into the sheet material, the control unit subsequently may control the motor 87 in order to move the sheet material for bending the sheet material in a next desired location. Since the abutments jaws 75 may continuously retain the end edge of the sheet material, a profile may be fabricated from the sheet material with very high accuracy. Furthermore the described apparatus thereby is very suitable for completely automatically bending desired profiles under control of a suitable computer.

Figure 10:
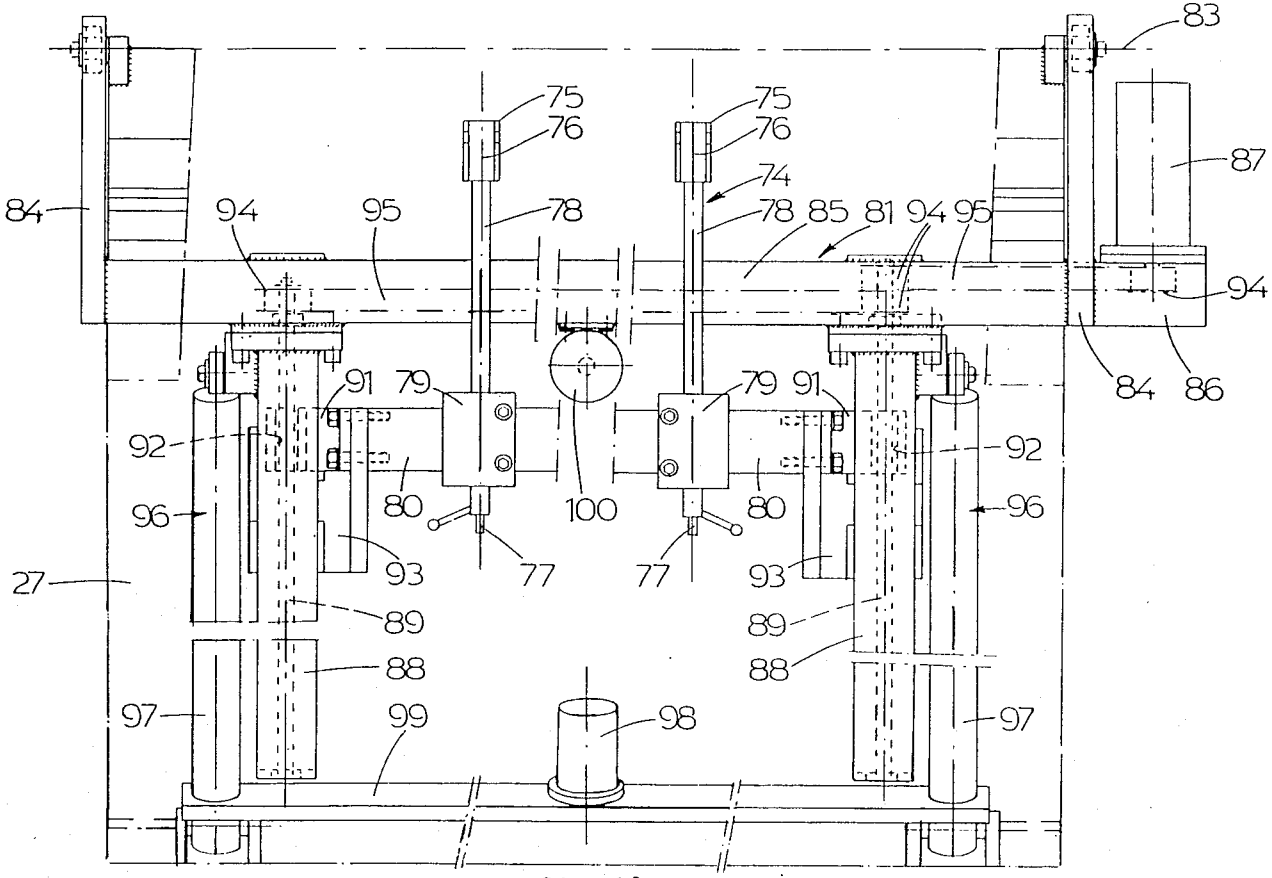
FIG. 10 is a view according to the line X—X of FIG. 8.

As appears from FIG. 10, the frame 81 furthermore includes a rotary platform 100 which is disposed nearly in the centre and which is movable upwardly and downwardly and which is capable of rotating the sheet material in a horizontal plane. For that purpose the sheet material with the abutment jaws 75 is positioned over the rotary platform 100, whereafter the sheet material is retained thereon. This may take place for example by applying a vacuum to openings formed in the rotary platform of by a rotatably mounted clamping means pressing the sheet material on the rotatary platform 100. After the rotation of the sheet material the end edge of the sheet material turned towards the abutment jaws 75 may be grasped whereafter the subsequent bending operations may be carried out.

Furthermore it is possible to provide the other die part 31 with an abutment 74 supported by a frame 81 which in the manner described above is pivotably connected with this die part 31.

Figure 11:
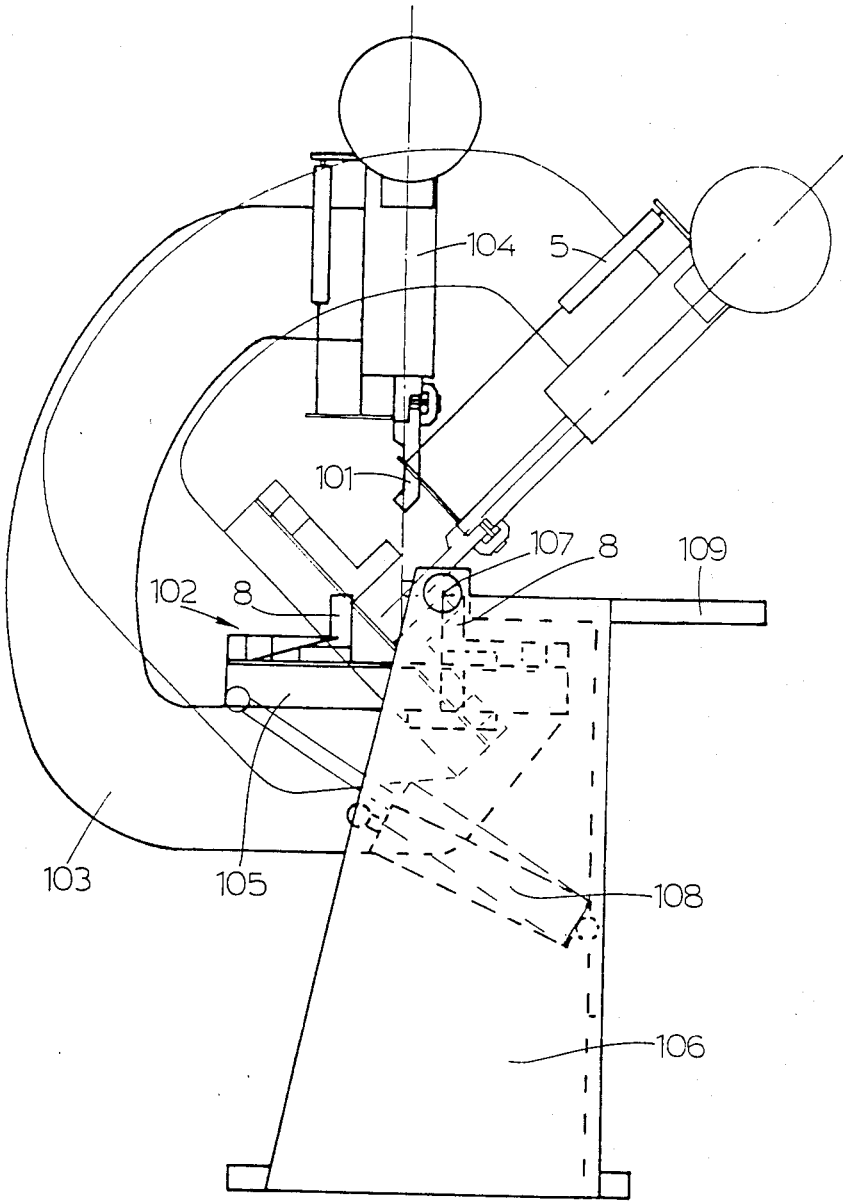
FIG. 11 is a schematically represented side view of an alternative embodiment of the apparatus of the invention.

FIG. 11 represents an alternative for the abutment 74 supported by the pivotable frame 81. In FIG. 11 the apparatus is drawn in thick lines in a starting position, while the apparatus is represented in thin lines in an end position in which the sheet material (not illustrated) is bent over 90° and the stamp 101 and the die 102 have been tilted over an angle of 45°. The die 102 which in the same manner as in the apparatus of FIG. 1 is provided with movable die parts 8 and the stamp 101 are mounted in one or more C-shaped frames 103 which at the upper side are connected together by a plate 104 and at the lower side by a die table 105. The die table 105 is rotatably supported by a base 106, the axis of rotation substantially coinciding with the contact zone 107 of the right die part 8.

The pivoting motion of the C-shaped frames 103 with the stamp 101 and the die 102 are effected by a hydraulic cylinder-piston assembly 108 which is pivotably connected with one of the frames 103 and the base 106. The pivoting motion is dependent of the movement of the stamp 101, which as in the embodiment of FIG. 1 is determined by a potentiometer 5.

In the embodiment of the apparatus illustrated in FIG. 11 the sheet material during the whole bending operation is supported by a table 109.

It is noted that the drive of various members by screw spindles as mentioned hereinabove of course can also be effected by other drive means like hydraulic cylinder-piston assemblies, for example.

The invention is not limited to the embodiments described hereinabove which may be modified in various manners within the scope of the invention.

Figure 9:
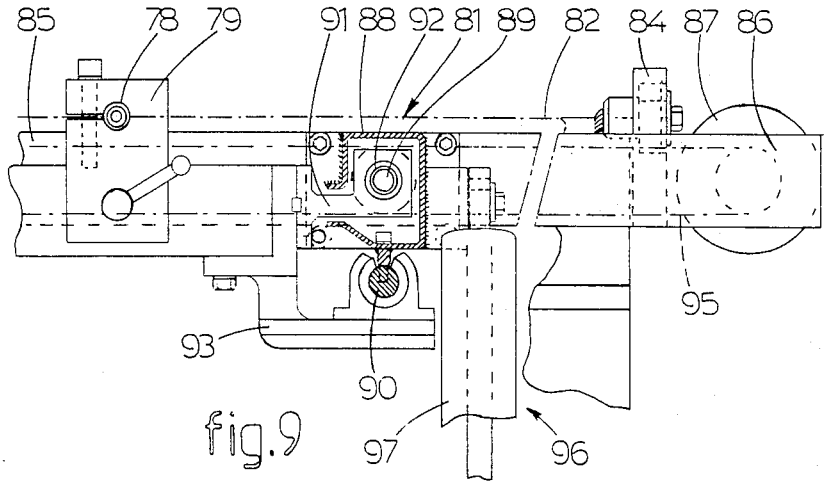
FIG. 9 is a view according to the line IX—IX of FIG. 8, partly in section.

The embodiment of the apparatus represented in FIG. 6 may also be provided with an abutment 74 supported by the pivotable frame 81 as illustrated in the FIGS. 8–10. For this purpose at either side of the die 55, for example, a support is mounted and the arms 84 are pivotably connected therewith. In one embodiment the pivoting axis of the frame 81 is adjustable substantially between the contact zone of the stamp part 63 when the same is positioned in the working position, and at least one of the contact zones of the die part 62 when the die part is positioned in the working position. Thereby it is obtained that the pivoting axis of the frame 81 extends substantially through the sheet material to be bent when the stamp part 63 is in the working position and when the die part 62 is in the working position, respectively.

As an alternative the pivoting axis of the frame 81 is adjustable within the area situated substantially between the contact zone of the stamp part 63 when the same is positioned in the working position, and the lowest point of the groove of the die part 62 when the die part is positioned in the working position. In this alternative embodiment the pivoting axis has to be moved in correspondence with the downward movement of the upper stamp part 63 during the bending of the sheet material, so that the pivoting axis will remain extending substantially through the sheet material during the bending of the material.

Since the sheet material in the apparatus of FIG. 6 during bending will slide, the abutment jaws 75 will have to follow this sliding motion. For this purpose the abutment jaws 75 may be mounted so as to be slidable against the effect of a spring. As an alternative the motor 87 may be controlled by the control unit for moving the abutment jaws 75 in dependency of the relative movement of the stamp 57 and the die 55. This movement in a manner as described hereinabove may be determined by a potentiometer.

I claim:

1. Apparatus for bending sheet material, including a die having at least one longitudinally extending groove and a stamp having at least one linear contact zone contacting the sheet material to be bent, the die and the stamp being movable toward each other, wherein the die and the stamp each include a pivotably supported carrier, said carriers each carrying at least a die part and a stamp part which may be positioned into a working position by pivoting of the carrier and means defining an abutment for contacting an edge of the sheet material to be bent, wherein the abutment is supported by a frame which is pivotably connected with the apparatus about a pivoting axis extending in parallel to the contact zone of the stamp part of the stationary carrier.

2. Apparatus according to claim 1, wherein the angular distance between the stamp part and the die part is larger than 90°.

3. Apparatus according to claim 1, wherein the die and/or the stamp is provided with a carrying member which at the lower side or upper side, respectively, is provided with a channel of U-shaped section, the upper end of the lower beam or the lower end of the upper beam, respectively, being received into the channel and including longitudinally spaced bores, the adjacent sidewalls of the channel being provided with slots at each bore, and a shaft is fitted in each bore, said shaft at both ends carrying eccentric stub axles projecting into the slots and being pivotably journaled in slide blocks mounted in the slots, and a drivable operating arm is secured on one of the stub axles for pivoting the respective shaft.

4. Apparatus according to claim 1, wherein the pivoting axis of the frame is adjustable substantially between the contact zone of the stamp part of the one carrier when the stamp part is in the working position and at least one of the contact zones of the die part of this carrier when the die part is in the working position.

5. Apparatus according to claim 1, wherein the pivoting axis of the frame is adjustable within the area substantially between the contact zone of the stamp part of the one carrier when the stamp part is in the working position, and the lowest point of the groove of the die part of this carrier when the die part is in the working position.

6. Apparatus according to claim 1, wherein the abutment against the effect of a spring is slidable transversely of the pivoting axis of the frame.

7. Apparatus according to claim 1, wherein the abutment is slidable transversely of the pivoting axis of the frame in dependency of the relative movement of the stamp and the die.

8. Apparatus according to claims 1, wherein the frame is connected with the apparatus by an actuating means which effects the pivotal motion of the frame in dependency of the relative movement of the stamp and the die.

9. Apparatus according to claim 1, wherein a rotary platform is provided, said platform being movable upwardly and downwardly, and being adapted to retain the sheet material to be bent.

10. Apparatus according to claim 1, wherein two abutment jaws are provided in which the respective end edge of the sheet material to be bent may be clamped.

11. Apparatus according to claim 10, wherein the frame includes a support beam which is parallel to the pivoting axis, and two arms are mounted on the beam for sliding motion in parallel to said pivoting axis, each arm at its end carrying an abutment jaw, and the support beam is slidable transversely of said pivoting axis.

12. Apparatus according to claim 11, wherein the frame carries two guide rods extending transversely of the pivoting axis and guiding the respective ends of the support beam.

13. Apparatus according to claim 12, wherein the frame is provided with two drivable screw spindles extending in parallel to the guide rods and each cooperating with a threaded bore in the respective end of the support beam.

14. Apparatus according to claim 1, wherein the frame includes a box beam which at both ends is pivotably connected with the die part about the pivoting axis by an arm, said box beam carrying a drive motor for moving the abutment transverse to the pivoting axis.

* * * * *